US010398960B2

(12) United States Patent
Morelius

(10) Patent No.: US 10,398,960 B2
(45) Date of Patent: Sep. 3, 2019

(54) GOLFING AID

(71) Applicant: Kati Schwendtke, Hamburg (DE)

(72) Inventor: Michael Morelius, Falun (SE)

(73) Assignee: Kati Schwendtke, Hamburg (DE)

( * ) Notice: Subject to any disclaimer, the term of this patent is extended or adjusted under 35 U.S.C. 154(b) by 0 days.

(21) Appl. No.: 15/543,886

(22) PCT Filed: Jan. 15, 2016

(86) PCT No.: PCT/SE2016/050018
§ 371 (c)(1),
(2) Date: Jul. 14, 2017

(87) PCT Pub. No.: WO2016/114711
PCT Pub. Date: Jul. 21, 2016

(65) Prior Publication Data

US 2017/0348579 A1 Dec. 7, 2017

(30) Foreign Application Priority Data

Jan. 16, 2015 (SE) ..... 1530004

(51) Int. Cl.
*A63B 69/36* (2006.01)
*A41F 3/00* (2006.01)
(Continued)

(52) U.S. Cl.
CPC ..... *A63B 69/3608* (2013.01); *A41F 3/00* (2013.01); *A41F 9/002* (2013.01); *A44B 11/001* (2013.01);
(Continued)

(58) Field of Classification Search
USPC ..... 473/205–216, 229, 266–277
See application file for complete search history.

(56) References Cited

U.S. PATENT DOCUMENTS 1,578,468 A * 3/1926 Rankin ..... A44B 11/005 206/101
1,606,849 A * 11/1926 Spear ..... A44B 11/005 224/163
(Continued)

FOREIGN PATENT DOCUMENTS

| | | |
|---|---|---|
| JP | 2015 002933 B1 | 3/2014 |
| KR | 20130071692 A | 7/2013 |
| WO | 2014065508 A1 | 5/2014 |

OTHER PUBLICATIONS

International Search Report for corresponding PCT/SE2016/050018, dated Jun. 10, 2016.
(Continued)

*Primary Examiner* — Nini F Legesse
(74) *Attorney, Agent, or Firm* — Sandberg Phoenix & von Gontard PC

(57) ABSTRACT

A kit of pieces is provided comprising a buckle (1), a pair of braces and at least one elongate guide stick. The buckle comprises a first portion (2), a second portion (3), and a clamp portion (4). The first portion (2) is situated in front of the second portion (3) when the buckle (1) is in use. The clamp portion (4) is configured to clamp a first end of a belt against the second portion (3), and the first portion (2) is configured to clamp a second end of the belt against the second portion (3). Further, the first portion (2) comprises at least one groove (6).

8 Claims, 6 Drawing Sheets

(51) Int. Cl.

| | |
|---|---|
| ***A41F 9/00*** | (2006.01) |
| ***A44B 11/12*** | (2006.01) |
| ***A44B 11/00*** | (2006.01) |
| *A63B 71/06* | (2006.01) |

(52) U.S. Cl.

CPC ..... *A44B 11/005* (2013.01); *A44B 11/12* (2013.01); *A63B 69/36* (2013.01); *A63B 2071/0694* (2013.01); *A63B 2209/10* (2013.01); *A63B 2210/50* (2013.01); *A63B 2225/09* (2013.01)

(56) References Cited

U.S. PATENT DOCUMENTS 3,935,977 A * 2/1976 Bonnett ..... A63C 11/025 211/70.5
4,113,157 A * 9/1978 Woodbury ..... A44B 11/005 206/37
4,393,556 A * 7/1983 Yuda ..... A44B 11/2588 24/662
5,397,121 A 3/1995 Gipson
5,569,095 A * 10/1996 McCollum ..... A63B 69/3608 273/DIG. 19
5,658,203 A * 8/1997 Shub ..... A63B 69/0059 473/205
5,879,240 A * 3/1999 Stuart ..... A63B 69/3608 473/215
6,132,322 A 10/2000 Bonham
6,206,787 B1 3/2001 Kleppen
6,360,410 B1 * 3/2002 Lovato ..... A44B 11/006 24/170
6,571,434 B2 * 6/2003 Ortiz ..... A44B 11/006 24/265 BC
7,066,825 B1 * 6/2006 Moussa ..... A63B 69/3608 473/207
7,784,655 B2 * 8/2010 Su ..... A44B 11/005 224/163
7,993,210 B1 * 8/2011 Hatfield ..... A63B 69/3608 473/215
8,157,665 B2 * 4/2012 Gibbs ..... A63B 69/3641 473/215
9,215,911 B1 * 12/2015 Carnley ..... A44B 11/005
2003/0109320 A1 6/2003 Perry
2009/0062087 A1 * 3/2009 Poppinga ..... A63B 21/0552 482/124
2011/0306434 A1 * 12/2011 Crabtree ..... A63B 69/0059 473/215
2012/0036618 A1 * 2/2012 Rowland ..... A41F 9/025 2/311
2013/0091668 A1 * 4/2013 Turdjian ..... A44B 11/06 24/579.11
2013/0167288 A1 * 7/2013 Rowland ..... A41F 9/002 2/338
2017/0020234 A1 * 1/2017 Taylor ..... A44B 11/005

OTHER PUBLICATIONS

Written Opinion for corresponding PCT/SE2016/050018, dated Jun. 10, 2016.

* cited by examiner

GOLFING AID

CROSS-REFERNCE TO RELATED APPLICATIONS

This application is the US National Stage under 35 U.S.C. § 371 of International App. No. PCT/SE2016/050018 filed on Jan. 15, 2016, which claims priority to Swedish App. No. 1530004-9 filed Jan. 16, 2015, both of which are incorporated herein by reference.

TECHNICAL FIELD

The present invention relates to a golfing aid kit comprising a belt buckle, a pair of braces and a guide stick. Further, the invention also relates to a belt buckle, as well as a pair of braces.

BACKGROUND

When playing golf it is important to move the body correctly when striking a blow in order to achieve a good hit. An instructor may show how the right posture is obtained and how the body should be moved during the strike, but during the actual strike, the individual player must himself control his own body. Further, it is of great importance to aim in the right direction. This is also hard for the amateur player. Often, a player considers himself to be aiming in the correct direction, whereas the ball ends up elsewhere.

Having an instructor to help with the aiming and correcting and giving his comments is a valuable source of learning, but most of the time the beginner golfer needs to practice on his own. On these occasions, it would come in handy if the golfer had an aid helping him with his posture and to aim in the right direction, as well as during the strike.

SUMMARY

An object of the present invention is to provide a new type of golfing aid which is improved over prior art and which eliminates or at least mitigates the drawbacks discussed above. More specifically, an object of the invention is to provide a golfing aid that can be individually adjusted and which helps a golfer with his posture as well as his swing. These objects are achieved by the technique set forth in the appended independent claims with preferred embodiments defined in the dependent claims related thereto.

In a first aspect of the invention, a kit of pieces comprising a buckle, a pair of braces and at least one elongate guide stick is provided. This kit is advantageous for a golf player who wants to practice on his own but get feedback regarding his posture and aiming as if he had a real instructor with him. The kit forms a complete golf training equipment for both aiming and visualization of the body posture.

In a second aspect, a buckle is provided, comprising a first portion, a second portion, and a clamp portion. The first portion is connected to the second portion and situated in front of the second portion when the buckle is in use. The clamp portion is configured to clamp a first end of a belt against the second portion. The first portion is configured to clamp a second end of the belt against the second portion, and the first portion comprises at least one groove. This buckle is advantageous in that a guide stick can be inserted into the groove. The stick provides the player with information about his posture and how his hips are moving during for example a swing. Further, a pen may be inserted into the groove instead, if the player does not want to use the guide stick for practice.

In one embodiment, the buckle is a belt buckle. It is advantageous to have the guide stick in close relation to the hips, such that the player can follow his hip movement thanks to the movement of the elongate stick, and therefore the buckle is for a waist belt.

In another embodiment, the groove extends horizontally across the first portion. This is advantageous since it is desired to provide the guide stick in a horizontal manner, in order to correctly represent the hip movement.

Preferably, the groove is shaped as a semi circle provided such that a space between the first portion and the second portion is formed. An advantage with this shape is that the guide stick fits optimally in a semi circular space.

The groove may be adapted to receive an elongate object when the buckle is in a closed position. An advantage with this is that the elongate object may be a guide stick which can be clamped between the first and second portions in order to securely keep its position during a golf swing.

In a third embodiment, a pair of braces is provided, which comprises two elongate straps which are connectable to a garment or accessory of a user. Each strap is provided with at least one loop. These braces are advantageous when a player wants to use more guide sticks, in order to further monitor and control his posture and aiming.

In one embodiment, each strap comprises a first end and a second end. The first ends are connectable to the garment or accessory spaced apart from each other and the second ends are attached to each other forming a common end portion which is connectable to the garment or accessory. This is an advantageous configuration of a pair of braces.

In another embodiment, each strap comprises a first end and a second end. These ends are connectable to the garment or accessory spaced apart from each other. This is an alternative configuration of a pair of braces. In this embodiment, the straps are interconnected on the back of the user by a horizontal crosspiece. This configuration of the braces provides better stability to the braces, by having four connection points, instead of three. Further, it is more likely for a guide stick inserted in loops provided on the part of the braces extending over the back of the user to be horizontal.

Preferably, the straps are attached to the belt by means of one of Velcro loops, buttons or snap fasteners. These are all reliable and easily maneuvered fastening means, suitable for attachment of braces to a garment.

The loops may be elongate and tubularly shaped. This is advantageous, since an elongate shape provides stability to the guide stick inserted into the loop, by keeping it horizontal. A tubular shape is advantageous for fitting a circular guide stick.

The extension of each elongate loop is in one embodiment in a horizontal direction. This is advantageous for maintaining the guide stick in a horizontal position. In one embodiment, at least one guide stick is insertable into one loop on each strap. The use of a guide stick is advantageous when a user wants to visualize his posture and aiming when training on his own.

In another embodiment, the straps are provided with loops from a position located on a users back, over the shoulders of the user and along his chest. This provides the braces with numerous possibilities to attach one or more guide sticks to the braces, depending on the size and shape of his body, and also the purpose of the stick.

In a fourth aspect, a use of a buckle as a golfing aid together with a guide stick or a pen is provided.

In a fifth aspect, a use of a pair of braces as a golfing aid together with at least one guide stick is provided.

BRIEF DESCRIPTION OF THE DRAWINGS

Embodiments of the invention will be described in the following; references being made to the appended diagrammatical drawings which illustrate non-limiting examples of how the inventive concept can be reduced into practice.

DETAILED DESCRIPTION

Hereinafter, certain embodiments will be described more fully with reference to the accompanying drawings. The invention may, however, be embodied in many different forms and should not be construed as limited to the embodiments set forth herein; rather, these embodiments are provided by way of example so that this disclosure will be thorough and complete, and will fully convey the scope of the invention, such as it is defined in the appended claims, to those skilled in the art.

FIGS. 1-5 show a belt buckle from different directions according to one embodiment. The buckle 1 comprises a mainly rectangularly shaped first portion 2 and a mainly rectangularly shaped second portion 3. Both the first portion 2 and the second portion 3 are mainly rectangular, but they need not be of the same dimensions. In other embodiments they may have a different shape, e.g. oval, square or circular. The first portion 2 is provided with a tiger head, but may in other embodiments be plain, or provided with e.g. text or a different logo.

In use, the first portion 2 is provided in front of the second portion 3 and the two parts are interconnected by e.g. a hinge mechanism (not shown) such that the buckle 1 can be opened and closed. Hence, hereafter the first portion 2 is also referred to as the front portion 2 and the second portion 3 is also referred to as the rear portion 3.

Figure 4:
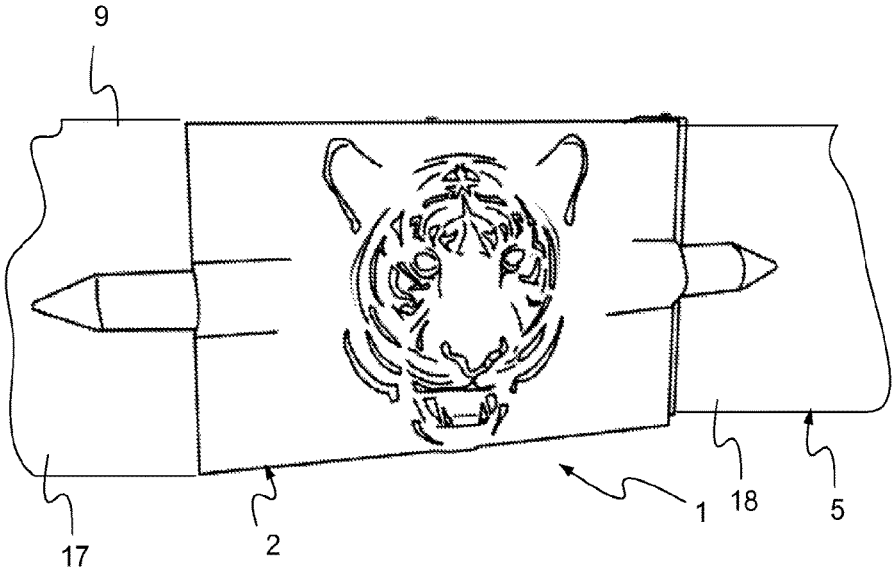
FIG. 4 is a front view of the belt buckle in a clamping position with a pen.
Figure 5:
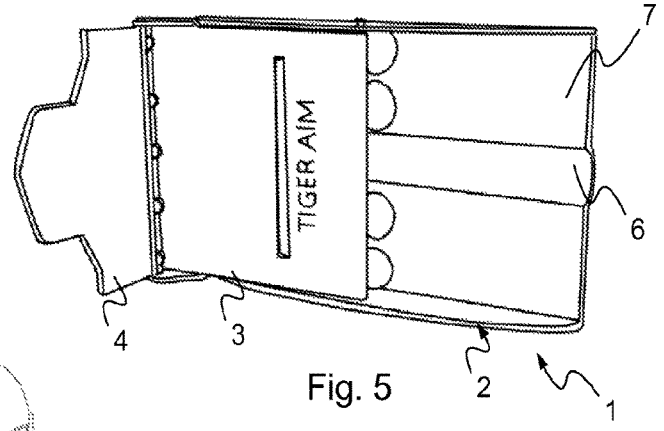
FIG. 5 is a perspective view from the back of the belt buckle in an open position.

Further, the rear portion 3 is interconnected with a clamp portion 4, e.g. via a hinge mechanism (not shown). As shown in FIG. 4 a first end 17 of an elongate belt 5 is clamped between the rear portion 3 and the clamp portion 4. Thus, the belt 5 and the belt buckle 1 are connected. In use, a second end 18 of the elongate belt 5 is inserted between the front portion 2 and the rear portion 3 and the buckle 1 is locked, by pushing the front portion 2 and the rear portion 3 against each other. The second end 18 of the belt 5 is thus kept in place by e.g. friction.

Figure 1:
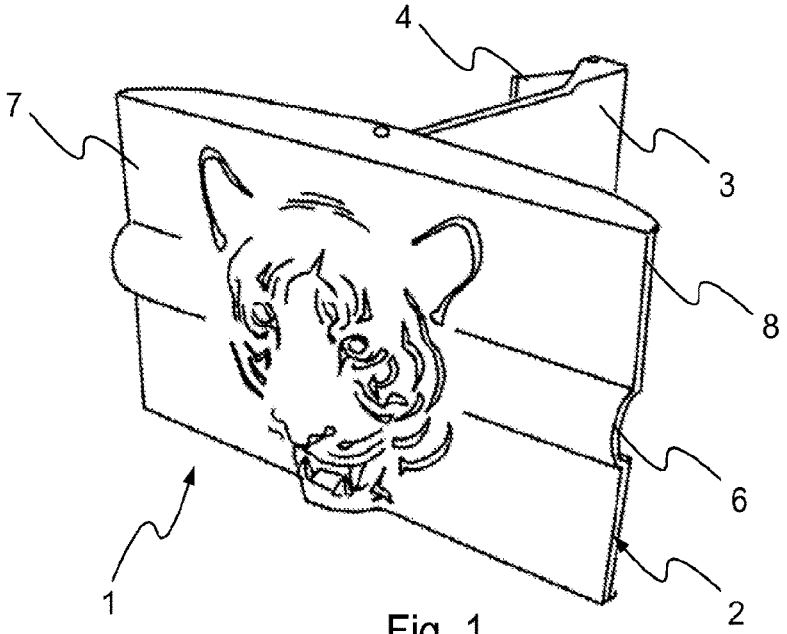
FIG. 1 is a perspective view of a belt buckle according to one embodiment.
Figure 2:
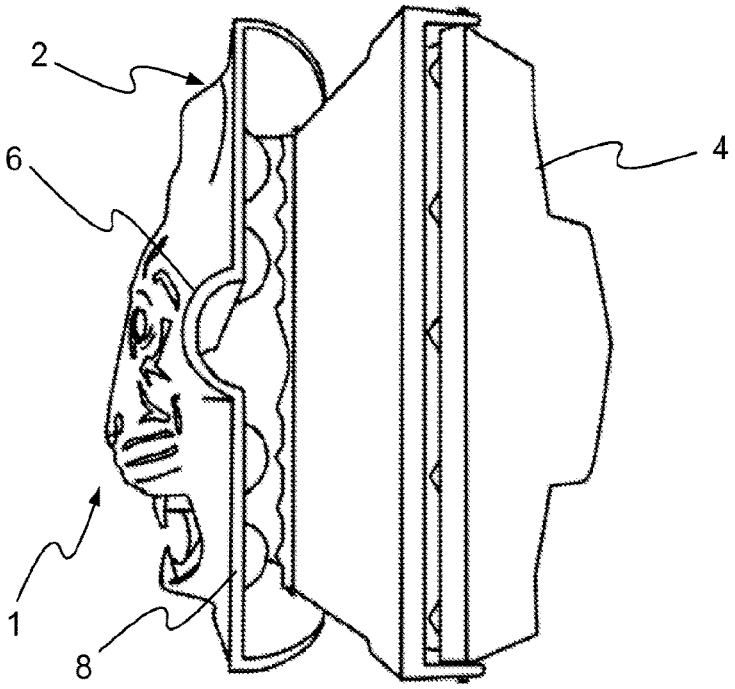
FIG. 2 is a side view of the belt buckle.
Figure 3:
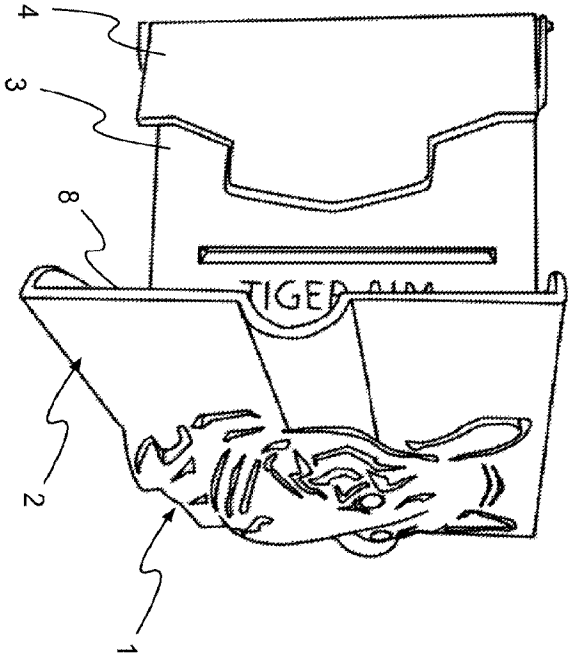
FIG. 3 is a perspective view of the belt buckle.

Referring to FIG. 2, where the belt buckle 1 is seen from the side, the front portion 2 comprises a horizontal groove 6. The groove 6 is provided from a first vertical side portion 7 to a second vertical side portion 8 of the front portion 2, thus forming an elongate channel 6. The cross section of the groove or channel 6 is semicircular with the flat and open side facing towards the rear portion 3. Thus, the groove 6 and the rear portion 3 form a semicircular hollow space, the benefit of which will be explained later.

The groove 6 is provided at the middle of the vertical side portions 7, 8. In other embodiments the groove 6 may be provided at different vertical heights. The front portion 2 may in other embodiments be provided with more than one vertical groove. If so, the grooves may, but are not required to, be parallel to each other.

Figure 6:
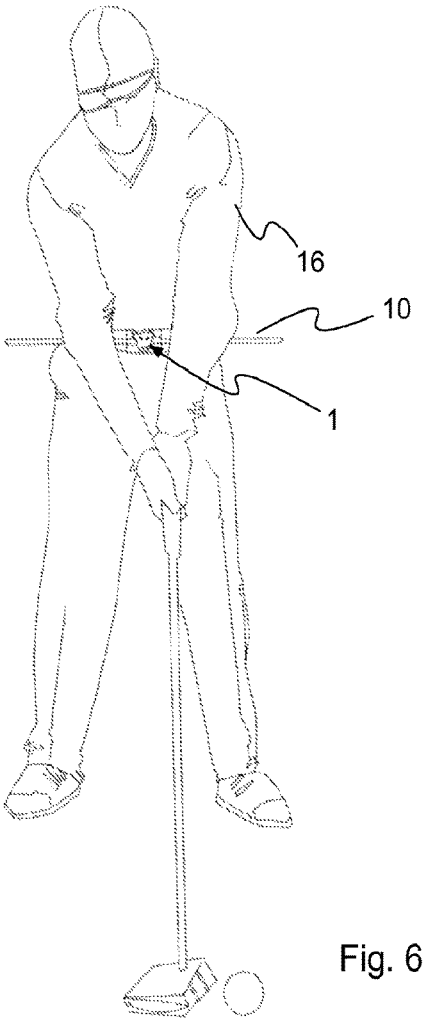
FIG. 6 is a perspective view of a user carrying a belt with the belt buckle with a guide stick attached.
Figure 7:
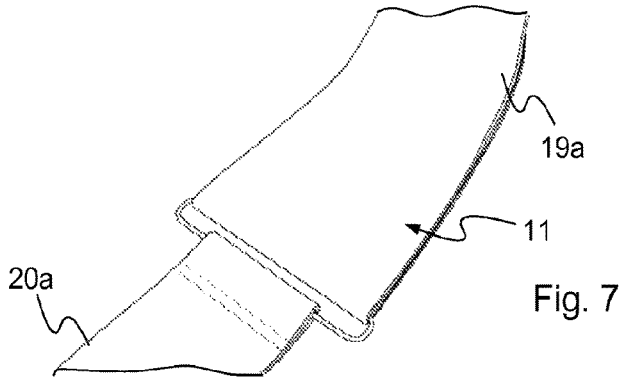
FIG. 7 is a perspective view of a detail of a brace strap according to one embodiment.
Figure 8:
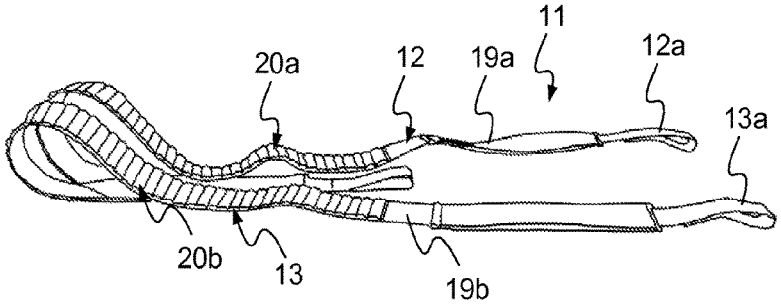
FIG. 8 is a perspective view of a pair of braces according to one embodiment.
Figure 9:
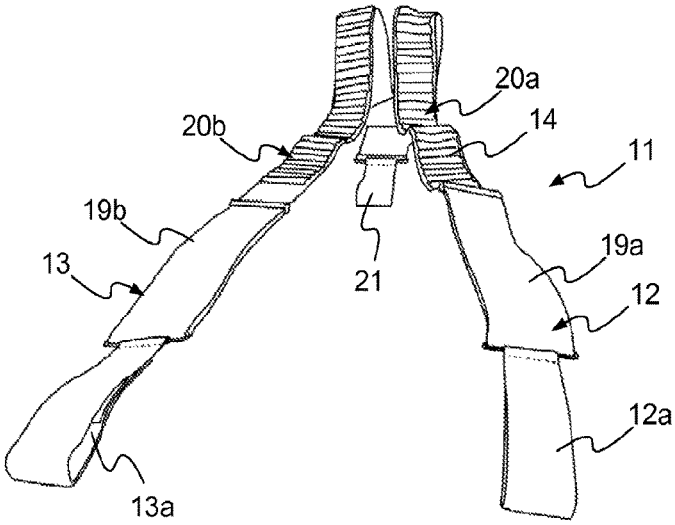
FIG. 9 is a perspective view of the braces in FIG. 9.
Figure 10:
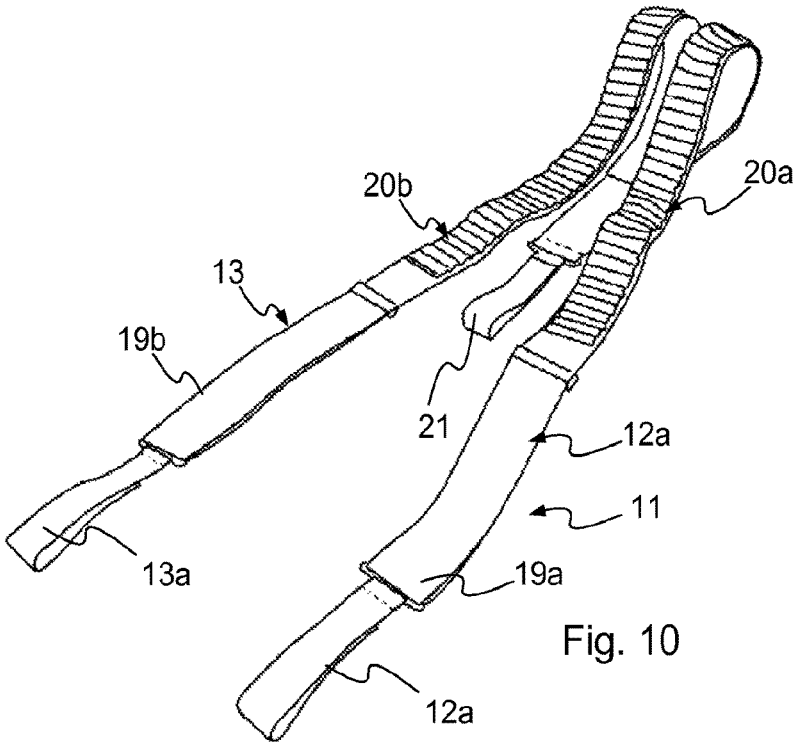
FIG. 10 is a perspective view of the braces in FIGS. 9 and 10.

The belt buckle 1 in use is shown in FIG. 6. Here is a golfer 16 shown, wearing a waist belt 5 provided with the above described belt buckle 1. An elongate guide stick 10 is inserted into the groove 6, such that approximately equally long portions of the stick 10 extend to the left and to the right of the buckle 1. When the player 16 initiates his swing he can easily check his hip position thanks to the elongate guide stick 10, which extends in the same direction as his hips. It is much easier to control the position of the hips by using the extended line provided by the stick 10 than measure by eye directly on the hips how they are turned.

The guide stick 10 is further useful for the player 16 during the backswing and forward swing as well as during the ready and completed swing. The guide stick 10 provided in the groove 6 makes the position of the hips clear to the player 16, and also for an assisting coach (not shown) who easily can point out the position of the guide stick 10. The player 16 can himself in a visual manner see the position and direction of the guide stick 10 in real time, and may, if necessary, adjust accordingly in order to optimize his own personal swing.

In FIG. 4 another use of the belt buckle 1 is shown. A pencil 9 is provided in the hollow space formed by the groove 6 such that the player 16 has it readily accessible when he is to mark his scorecard. In one embodiment (not shown) the buckle 1 comprises more than one, e.g. two, grooves in which a pencil can be put in one of them, and a guide stick in the other. Alternatively, two, or more, guide sticks 10 may be used at the same time.

In FIGS. 7-11 a second embodiment, comprising a set of braces 11, is shown. The braces 11 comprise two elongate straps 12, 13, preferably comprising a fabric. A first end of each strap 12*a*, 13*a* is provided with Velcro. Second ends 12*b*, 13*b* of the straps 12, 13 are joined to a common end portion 21 to form a V-shaped set of braces 11. Also the joint end 21 is provided with Velcro. The Velcro allows for connecting the braces 11 to the belt 5 described above. The Velcro-portion is bent around the belt 5 and attached to itself. This provides for a flexible solution by which the braces 11 may be put on and taken of quickly and easily. Thus, the belt 5 can be used both separately, and together with the braces 11. The Velcro portions may in other embodiments be replaced by e.g. buttons, snap fasteners or any other suitable connection means. The Velcro could in other embodiments be attached to belt loops on e.g. a pair of trousers.

Figure 11:
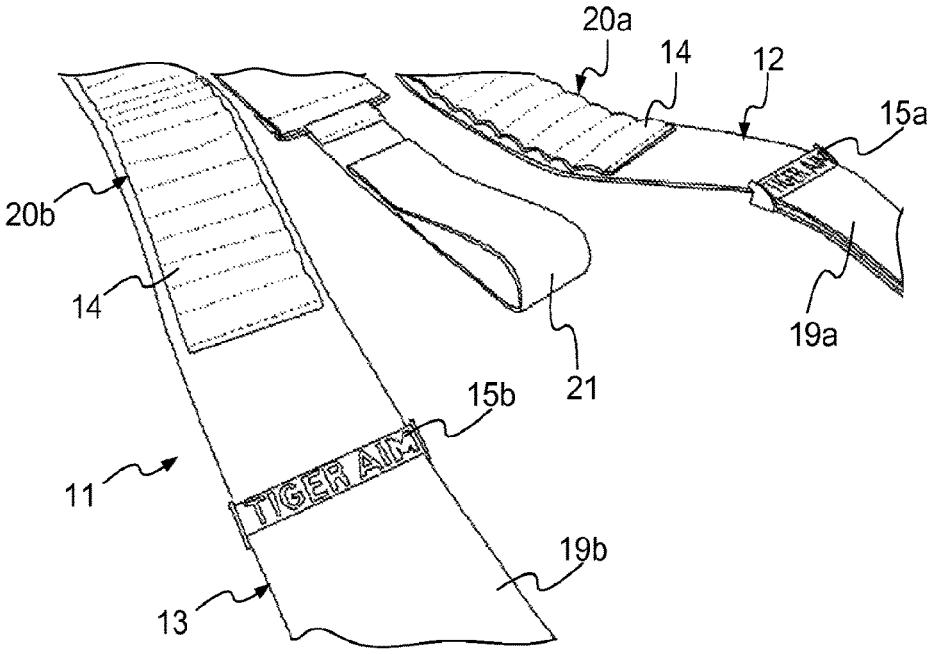
FIG. 11 is a detail of the braces of FIGS. 9-11.

As best seen in FIG. 11, a portion 20*a*, 20*b* is provided with loops 14 sewn onto the first 12 and the second 13 strap of fabric. A large number of loops 14 are provided along the straps 12, 13, starting on the upper half of the back of a player 16 wearing the braces 11, and continues over the shoulders and along the upper body of the player 16. A guide stick 10 is insertable into a pair of loops 14, one on each strap 12, 13. Preferably, the loops 14 used are located on the same height on the strap 12 and on the strap 13, such that the guide stick 10 is provided horizontally. Between the loop portions 20*a*, 20*b* and the end portions 12*a*, 13*a* an intermediate portion 19*a*, 19*b* is provided which is used to adjust the length of the braces 11 such that they can be comfortably used by wearers 16 of different sizes and shapes.

The large number of loops 14 provides for the possibility to attach the guide stick 10 at different heights such that an adaption to different people's 16 differing body proportions is achieved. Further, more than one stick 10 may be used. Alternatively, one stick 10 may be provided at the chest of the player 16, and another stick 10 on the player's 16 back. Further, the straps 12, 13 are provided with adjustment slides 15*a*, 15*b*, such that the length of the braces 11 becomes adjustable.

In one embodiment the measures of the parts of the braces 11 are according to the following:

The end portions 12*a*, 13*a* provided with Velcro are about 90 mm long when folded in half, forming loops for the belt 5.

The width of the end portions 12, 13 is about 28 mm.

The portion 20 provided with loops 14 are about 410 mm long.

The length of the intermediate portion 19 is adjustable between about 230-410 mm.

The width of the straps 12, 13 is approximately 35 mm.

The length of the elongate loops is approximately 28 mm.

The diameter of the loops 14 is about 8 mm.

Figure 12:
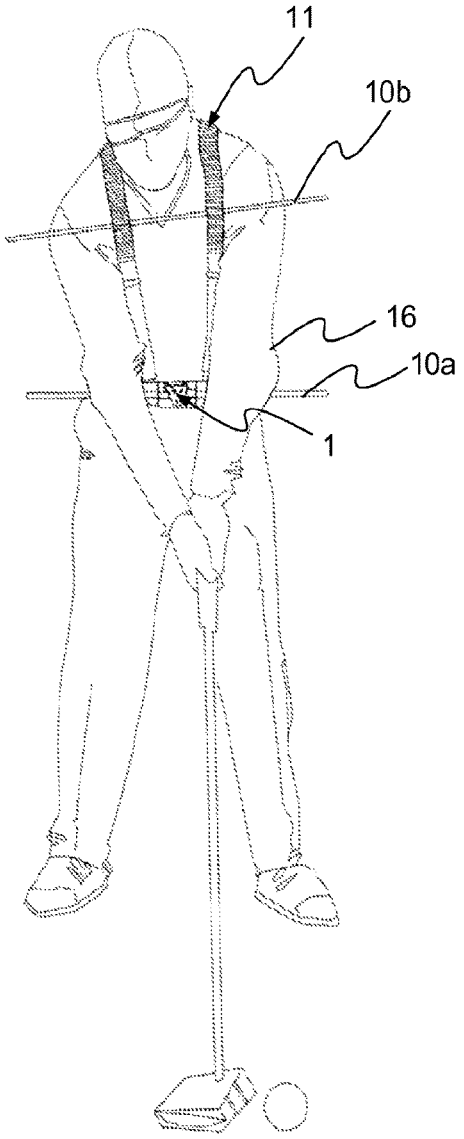
FIG. 12 is a perspective view of a user carrying both the belt with the belt buckle with a guide stick, and the braces with a guide stick.

In FIG. 12 a user 16 is shown wearing a belt 5 with the belt buckle 1 and the braces 11. He has inserted a first guide stick 10*a* into the horizontal groove 6 of the buckle 1, and another guide stick 10*b* into one of the pairs of loops 14 arranged on the braces 11. Thereby, he may use the direction of the guide stick 10*a* to e.g. adjust his hip position, and the guide stick 10*b* to e.g. adjust his aiming.

Figure 13:
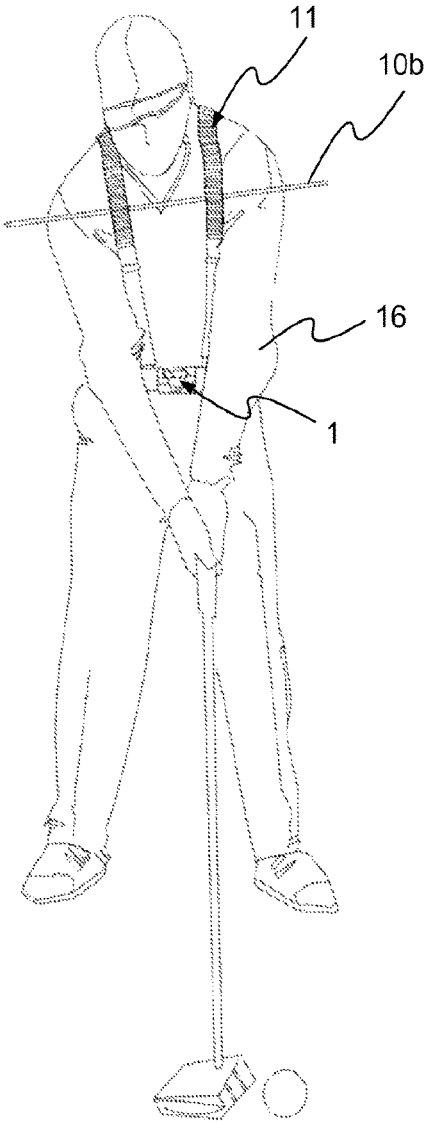
FIG. 13 is a perspective view of a user carrying the belt with the belt buckle and the braces with a guide stick attached.

The player 16 in FIG. 13 only uses the guide stick 10*b* inserted into one of the pair of loops 14 in the braces 11.

The belt 5 with the buckle 1 and the braces 11 are thus advantageous to use together as a practicing kit, but are also separable and may be used individually. The belt 5 with the buckle 1 is also advantageous to use in regular golf playing, used e.g. as a pen carrier.

Translation of the Priority Document

Descriptive functionalities in the patent application on belt buckle and braces comprising attachment device by a plurality of attachment points with loops for one or several guide sticks. The application refers to one or more guide sticks or anything else that is compatible with golf or golf equipment used for golf practice as one might attach to the body by means of my unique attachment device by the belt buckle or loops provided on the braces.

Function: The belt buckle and braces for attachment of guide sticks showing direction, position, base position as well as of assistance to see speed, plane of the swing, and that the hip is following correctly in swing. The belt buckle and braces are connected and are intended for one or more guide sticks in use. Belt buckle and braces can also be released and used separately as desired. The buckle of the belt can also be used during a game where you do not use guide sticks but which can be used to attach a marker pen for a scorecard.

1. The belt buckle can one by opening the buckle attach one or more guide sticks to see the position of the hip in base position for initiation if swing, back swing as well as forward swing and finished and completed swing. The guide stick shows the position of the hip for the practitioner and for an assisting coach who easily may visually point at the direction of the guide stick and the practitioner can see this in real time himself and directly adjust to optimize his personal swing if necessary.

2. The braces can attach one or more guide sticks as the braces comprises a plurality of loops, straps one insert the guide stick through to attach. These loops start at the upper portion of the back, the shoulders and continues down on the front side of the body in height with the chest.

3. Braces and belt buckle can be used together or separately. Thus, may be released from each other completely according to the preferences of the user to improve his swing plane, swing track, direction, length, speed of the swing to obtain improved and simplified precision in his swing performance.

4. The buckle of the belt may also be used to attach a marker pan for score board during a game when no guide sticks are used.

Device

Attachment device for one or more guide organs or guide stick or marker pen for golfing.

The structure, function, measures design of the belt buckle and braces with loops/channels function for attachment of guide organ or guide stick or marker pen in the belt buckle or braces with the same functionality or implementation.

The loops/channels on braces with the intention of attaching guide organs or guide sticks one or more same is valid for belt buckle.

The loops/channels attached to the braces with the dimensions or the intention for attachment solution of guide organ or guide stick on the upper body or lower body.

Attachment solution for guide sticks or guide organ on hip or upper body in golfing. Applies to one or more guide organs or guide sticks or marker pens with the intention to attach on the body for the same functionality or use.

Use

Attachment device for one or more guide organs or guide stick or marker pen for golfing.

The structure, function, measures design of the belt buckle and braces with loops/channels function for attachment of guide organ or guide stick or marker pen in the belt buckle or braces with the same functionality or implementation.

The loops/channels on braces with the intention of attaching guide organs or guide sticks one or more same is valid for belt buckle.

The loops/channels attached to the braces with the dimensions or intention for attachment of guide organ or guide stick on the upper body or lower body.

Attachment of guide sticks or guide organ on hip or upper body in golfing. Valid for one or more guide organs or guide sticks or marker pens with the intention to attach to the body for same functionality or use.

Method

Production of attachment device with loops/channels attachment of belt buckle for one or more guide organs or guide stick or marker pen in golfing.

The structure, function, measures design of the belt buckle and braces with loops/channels function for attachment of guide organ or guide stick or marker pen in the belt buckle or braces with the same functionality or implementation.

The loops/channels on braces attachment functionality belt buckle with the intention of attaching guide organs or guide sticks one or more same is valid for belt buckle.

The loops/channels attached to the braces with the dimensions or intention for attachment of guide organ or guide stick on the upper body or lower body.

Attachment of guide sticks or guide organ on hip or upper body in golfing. Valid for one or more guide organs or guide sticks or marker pens with the intention to attach to the body for same functionality or use.

The invention claimed is:

1. A golfing aid comprising a belt buckle for a waist belt, said belt buckle comprising a first portion, a second portion pivotally connected at a first end of said second portion to said first portion between opposite ends of said first portion, and a clamp portion positioned at a second end of said second portion, wherein the first portion is situated in front of the second portion when the buckle is in use; wherein the clamp portion is configured to clamp a first end of the waist belt against the second portion, and wherein the first portion is configured to clamp a second end of the belt against the second portion, wherein the first portion comprises a first vertical side portion, a second vertical side portion opposite said first vertical side portion, and top and bottom portions extending between said first and second vertical side portions, said top and bottom portions defining a middle area therebetween, said first portion further including at least one groove extending along a rear surface of said first portion in said middle area of said first portion from said first vertical side portion to said second vertical side portion of the first portion to form an elongate channel, said groove being adapted to receive and clamp an elongate object between the first and second portions when the buckle is in a closed position.

2. The device according to claim 1, wherein the at least one groove extends horizontally across the first portion.

3. The device according to claim 1, wherein the at least one groove is shaped as a semicircle, such that an approximately semicircular space between the first portion and the second portion is formed when the golf aid is in use.

4. A kit for practicing golf comprising the golfing aid according to claim 1, and at least one elongate guide stick.

5. The device according to claim 1 wherein said second portion of said buckle extends from said rear surface of said first portion of said buckle.

6. The device according to claim 5 wherein said second portion is hingedly connected to said first portion such that the first and second portions to pivot relative to each other.

7. The golfing aid according to claim 1 wherein said first portion including an outer surface opposite said rear surface; said groove on said rear surface of said first portion defining a corresponding raised portion on said outer surface.

8. A golf training aid comprising a buckle, said buckle comprising:

a first portion having first and second opposed end edges, a top edge and a bottom edge extending between said first and second opposed ends, a front surface, and a back surface, said top and bottom edges defining therebetween a middle area of said front and back surfaces; and at least one groove being formed in the middle area of said back surface, said groove extending from said first edge to said second edge of the first portion to form an elongate channel;

a second portion pivotally connected to said first portion between the opposed end edges of said first portion at a first end of said second portion whereby said first and second portions are movable relative to each other between an open position and a closed position; said channel being adapted to receive and clamp an elongate object between the first and second portions when the buckle is in said closed position; and a clamp portion at a free end of said second portion of said buckle; said clamp portion being operable to connect said buckle to a belt.

* * * * *